United States Patent [19]

Runte

[11] 4,055,222

[45] Oct. 25, 1977

[54] EARTH MOVING IMPLEMENT WITH ADJUSTABLE WHEEL ASSEMBLY

[76] Inventor: Donald J. Runte, 1220 Hillcrest Drive, Freeport, Ill. 61032

[21] Appl. No.: 681,390

[22] Filed: Apr. 29, 1976

[51] Int. Cl.[2] ..... E02F 3/64

[52] U.S. Cl. ..... 172/413; 37/DIG. 20; 172/460; 172/680

[58] Field of Search ..... 37/DIG. 20, DIG. 13, 37/DIG. 14, 129, 132, 124; 180/41; 280/6 H; 172/4.5, 413, 797, 459, 460, 421, 423, 316, 315, 318, 321

[56] References Cited

U.S. PATENT DOCUMENTS

| | | | |
|---|---|---|---|
| 1,699,167 | 1/1929 | Throop | 172/460 |
| 1,759,982 | 5/1930 | Hauser | 172/413 |
| 2,025,285 | 12/1935 | Hunter et al. | 37/129 |
| 2,051,283 | 8/1936 | Austin | 172/413 |
| 2,078,501 | 4/1937 | Maloon | 172/413 |
| 2,647,758 | 8/1953 | Ryan | 37/DIG. 14 |
| 2,734,293 | 2/1956 | Barnes | 37/DIG. 20 |
| 3,097,440 | 7/1963 | Schmidt | 37/129 |
| 3,526,047 | 9/1970 | Roessler et al. | 37/DIG. 20 |
| 3,561,538 | 2/1971 | Curlett et al. | 172/4.5 |
| 3,608,643 | 9/1971 | Flood et al. | 172/200 |

FOREIGN PATENT DOCUMENTS

| | | | |
|---|---|---|---|
| 1,101,473 | 1/1968 | United Kingdom | 37/DIG. 20 |

OTHER PUBLICATIONS

Goodfield Earth Movers; Goodfield Producers, Inc.; Goodfield, Illinois; Date: before 1970.

*Primary Examiner*—Clifford D. Crowder
*Attorney, Agent, or Firm*—Leydig, Voit, Osann, Mayer & Holt, Ltd.

[57] ABSTRACT

The implement includes a bucket having a lower scraping blade. A pair of laterally spaced ground-engaging wheels are pivotally supported on the rear of the bucket and may be swung upwardly and downwardly in unison to change the elevation of the bucket. One of the wheels may be shifted upwardly and downwardly relative to the other wheel to tilt the implement about a fore-and-aft extending axis and thereby enable the bucket to work at various inclinations.

3 Claims, 4 Drawing Figures

EARTH MOVING IMPLEMENT WITH ADJUSTABLE WHEEL ASSEMBLY

BACKGROUND OF THE INVENTION

This invention relates to an earth moving implement of the type having a bucket with laterally spaced side walls, a rear wall, and a scraping blade extending along the rear wall between the lower rear portions of the side walls. The implement is adapted to be towed behind a tractor or the like and serves to scrape dirt or other material from the ground, the dirt being contained between the side walls of the bucket.

A wheel assembly is pivotally mounted on the rear of the bucket and includes a pair of laterally spaced ground-engaging wheels. By pivoting the wheel assembly upwardly and downwardly with a hydraulic actuator, the elevation of the scraper blade may be changed and the bucket may be raised and lowered for the purpose of dumping the accumulated dirt.

SUMMARY OF THE INVENTION

The primary aim of the present invention is to increase the versatility of an earth moving implement of the above type by adapting the implement for tilting about a fore-and-aft axis so that the inclination of the bucket may be changed to enable scraping at various grades, such tilting being possible regardless of the elevation of the blade.

A more detailed object is to achieve the foregoing by mounting one of the ground-engaging wheels for up and down linear adjustment relative to the other wheel and by providing means for shifting the one wheel upwardly and downwardly and thereby effect tilting of the bucket about a fore-and-aft axis.

The invention also resides in the relatively simple and inexpensive construction of the parts used to mount the one wheel for up and down shifting.

These and other objects and advantages of the invention will become more apparent from the following detailed description when taken in conjunction with the accompanying drawings.

Figure 1:
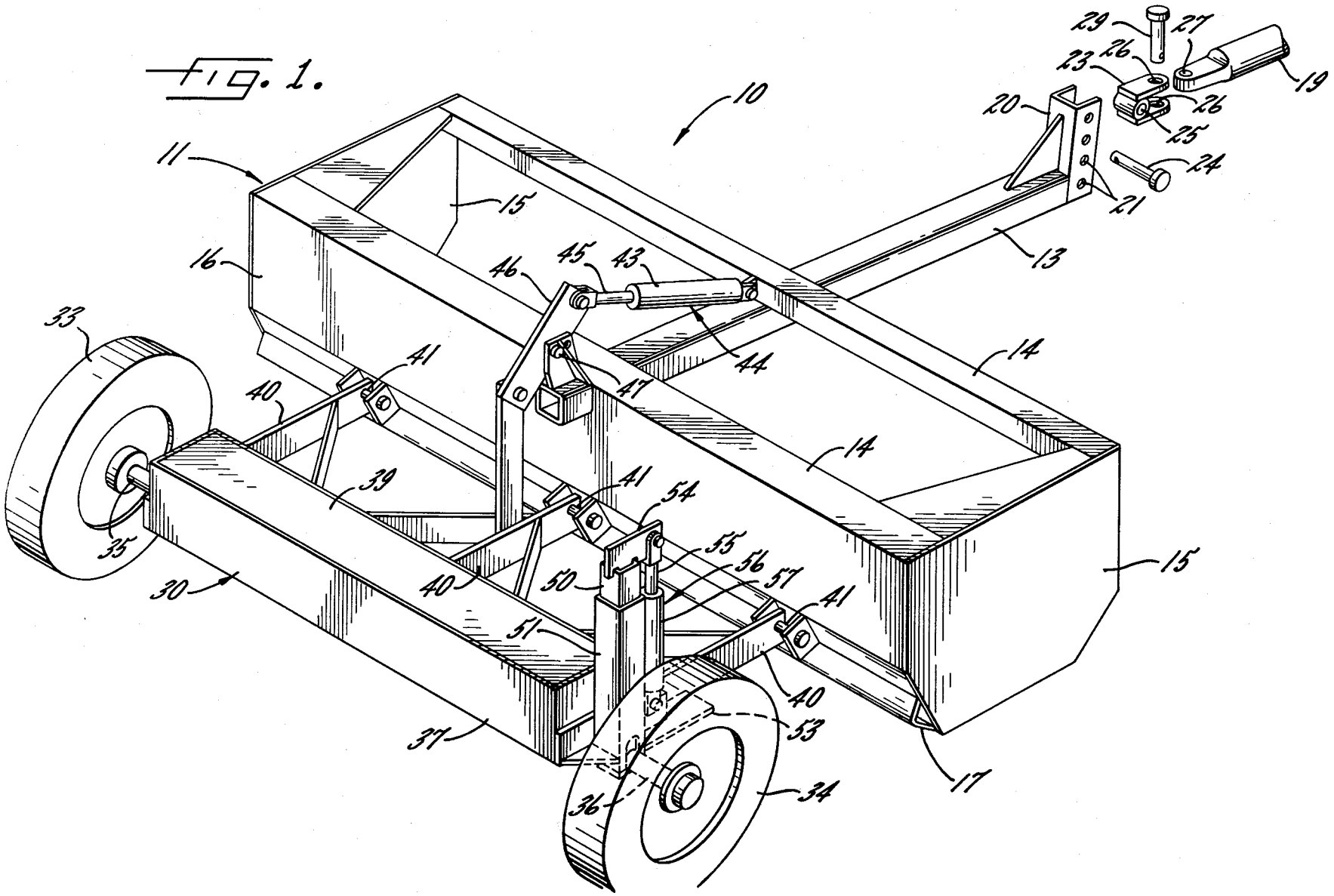
FIG. 1 is a perspective view of a new and improved earth moving implement incorporating the unique features of the present invention, part of the view being in exploded form.

FIG. *2a* is a rear view of the implement, in somewhat schematic form, and showing the bucket disposed in a normal horizontal position.

FIGS. *2b* and *2c* are views similar to FIG. *2a* but show the implement tilted in opposite directions from its normal horizontal position.

DETAILED DESCRIPTION OF THE PREFERRED EMBODIMENT

As shown in the drawings for purposes of illustration, the invention is embodied in an earth moving implement 10 having a bucket 11 for scraping up dirt, snow, debris and the like and for moving the material from place-to-place. The bucket is connected to a forwardly projecting tongue 13 and includes a frame 14 which supports a pair of laterally spaced side walls 15. An upright rear wall 16 spans the rear edges of the side walls and carries a scraper blade 17 which extends transversely between the lower rear portions of the side walls. The front of the bucket is open and thus scraped dirt accumulates in and is moved forwardly by the bucket as the latter is pulled along the ground.

The tongue 13 is adapted to be hitched to the draw bar 19 of a tractor or other towing vehicle and, for this purpose, an upright channel 20 is fixed to the forward end of the tongue and is formed with several vertically spaced pairs of horizontally extending holes 21. A U-shaped clevis-like member 23 is adapted to fit in the channel and may be secured thereto by a pin 24 inserted through one of the pairs of holes and through a horizontal hole 25 in the rear of the clevis. A pair of vertical holes 26 in the front of the clevis and a hole 27 in the draw bar 19 accommodate a vertical pin 29 for detachably securing the tongue to the draw bar. The holes 26 and 27 are substantially larger in diameter than the pin 29 and allow the tongue to tilt about a fore-and-aft extending axis. The tongue also may swing upwardly and downwardly about the axis of the pin 24.

Carried on the rear of the bucket 11 is a wheel assembly 30 which may be swung upwardly and downwardly relative to the bucket to effect lowering and raising of the scraper blade 17 relative to the ground. The wheel assembly also may be swung downwardly to lift the bucket upwardly away from a pile of dirt which has accumulated in the bucket.

In this instance, the wheel assembly 30 includes a pair of laterally spaced wheels 33 and 34 journaled on axles 35 and 36, respectively. The axles project laterally from the ends of a support 37 in the form of an elongated box which is adapted to be filled with concrete 39 or other heavy material in order to add weight to the rear of the implement 10.

Three struts 40 project forwardly from the box 37 and are pivotally connected at their forward ends at 41 to the rear wall 16 of the bucket 11, the wheel assembly 30 thus being mounted to swing upwardly and downwardly relative to the bucket. To effect such swinging, the cylinder 43 of a reversible hydraulic actuator 44 is connected to the frame 14, and the rod 45 of the actuator is pivotally connected to the upper end of a lever 46 which is pivoted on the rear of the bucket 11 at 47 to swing upwardly and downwardly. The lower end of the lever is pivotally connected to the upper end of an upstanding bar 49 which is rigid with the middle strut 40. The actuator 44 may be operated from the tractor and, when the rod 45 is extended and retracted, the wheels 33 and 34 are swung downwardly and upwardly relative to the bucket 11.

In accordance with the present invention, the wheel 34 is supported for up and down linear shifting relative to the wheel 33 so as to enable the bucket 11 to be tilted in opposite directions about a fore-and-aft extending axis. In this way, the bucket can be positioned to scrape on various inclines and to impart a desired grade to the earth or other material. When the bucket is tilted, the normal up and down swinging action of the wheel assembly 30 is not effected and thus the bucket still can be raised and lowered in the usual manner.

More specifically, the wheel 34 is supported for up and down shifting by attaching the inner end of the axle 36 to the lower end of an upright bar 50 of rectangular cross-section. The bar, in turn, is slidably telescoped into a rectangular sleeve 51 which is attached to a gusset 53 on the end of the box 37. A plate 54 projects forwardly from the upper end of the bar and is connected to the rod 55 of an upright hydraulic actuator 56 whose cylinder 57 is connected to the gusset 53.

Figure 2A:
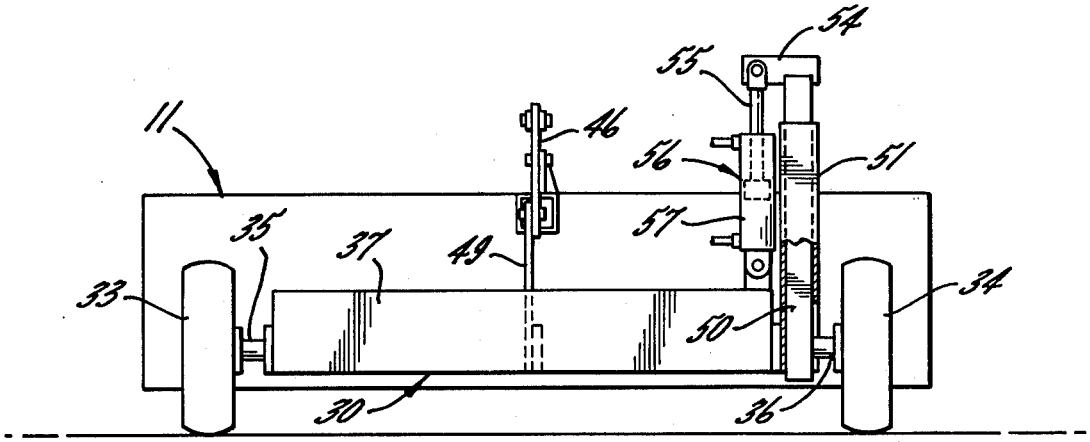
Figure 2B:
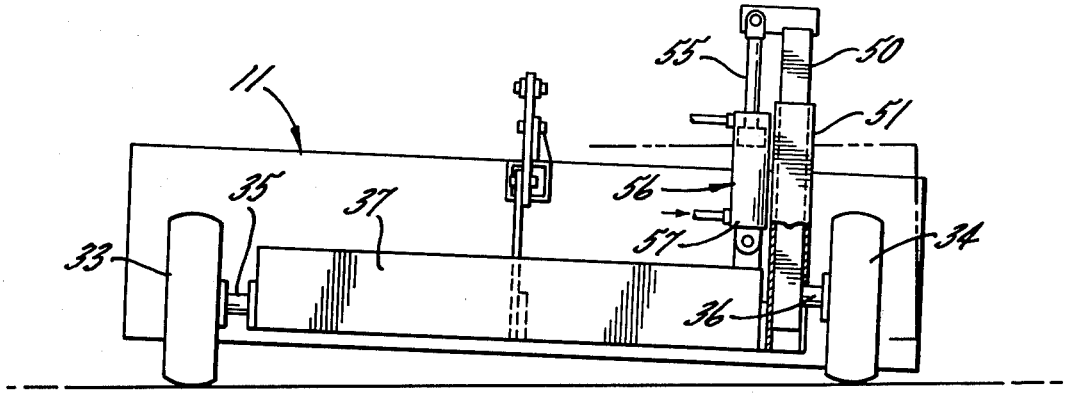
Figure 2C:
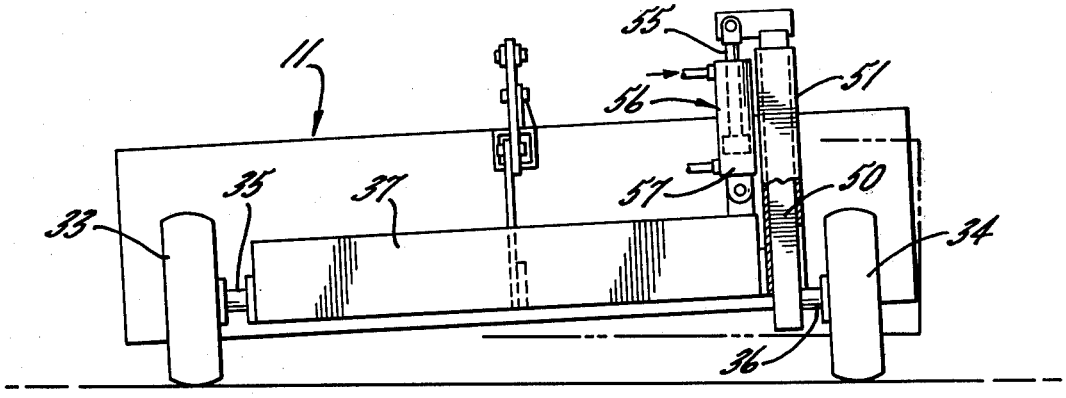

The actuator 56 may be controlled from the tractor and, when the rod 55 is in a centered position as shown in FIG. 2*a*, the axles 35 and 36 are both disposed at the same elevation and thus the bucket 11 is held in a laterally horizontal position. When the rod 55 is extended, the wheel 34 is raised relative to the wheel 33 and thus the implement 10 tilts laterally as shown in FIG. 2*b* so as to incline the bucket 11 and scraper blade 17 in one direction relative to the horizontal. By retracting the rod 55 below its centered position as shown in FIG. 2*c*, the wheel 34 is lowered relative to the wheel 33 and thus the bucket is tilted in the opposite direction. Accordingly, raising and lowering of the wheel 34 enables the bucket to be tilted and to work at various inclines. In any position of the bucket, the actuator 44 still may be operated to wing the wheels upwardly and downwardly in unison and thus change the elevation of the bucket.

I claim:

1. An earth mover adapted to be towed in a forward direction and comprising a bucket having laterally spaced upright side walls and having a scraping blade extending between the lower rear portions of said side walls, means attached to and projecting forwardly from said bucket for connecting the latter to a towing vehicle, a wheel assembly comprising a support and a pair of laterally spaced ground-engaging wheels attached to said support, means mounting said support for up and down pivoting on the rear of said bucket and about a transversely extending axis, a reversible hydraulic actuator connected between said bucket and said support and operable when operated in opposite directions to wing said support and said wheels upwardly and downwardly in unison relative to said bucket and about said axis and thereby effect lowering and raising of said scraper blade with respect to the ground, means mounting one of said wheels for up and down linear movement relative to said support and said other wheel, and a second reversible hydraulic actuator connected between said support and said one wheel and operable when operated in opposite directions to shift said one wheel upwardly and downwardly relative to said support and said other wheel and thereby effect tilting of the bucket about a fore-and-aft extending axis.

2. An earth mover as defined in claim 1 in which said last-mentioned mounting means comprises an upright sleeve attached rigidly to said support, a bar guided for up and down sliding in said sleeve and held against rotation within the sleeve, said one wheel being carried on the lower end portion of said bar, and said second hydraulic actuator being connected to the upper end portion of said bar.

3. An earth mover as defined in claim 2 in which said sleeve and said bar are of rectangular cross-section.

* * * * *